US010041680B2

(12) United States Patent
Asai et al.

(10) Patent No.: US 10,041,680 B2
(45) Date of Patent: Aug. 7, 2018

(54) GAS TURBINE COMBUSTOR

(71) Applicant: Mitsubishi Hitachi Power Systems, Ltd., Nishi-ku, Yokohama (JP)

(72) Inventors: Tomohiro Asai, Yokohama (JP); Akinori Hayashi, Yokohama (JP); Yasuhiro Akiyama, Yokohama (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 0 days.

(21) Appl. No.: 14/818,006

(22) Filed: Aug. 4, 2015

(65) Prior Publication Data

US 2016/0040883 A1 Feb. 11, 2016

(30) Foreign Application Priority Data

Aug. 5, 2014 (JP) ..... 2014-159330

(51) Int. Cl.
*F23R 3/28* (2006.01)
*F23R 3/00* (2006.01)
(Continued)

(52) U.S. Cl.
CPC ..... *F23R 3/286* (2013.01); *F23R 3/002* (2013.01); *F23R 3/10* (2013.01); *F23R 3/343* (2013.01);
(Continued)

(58) Field of Classification Search
CPC .. F23R 3/286; F23R 3/28; F23R 3/346; F23R 3/002; F23R 3/10; F23R 3/16;
(Continued)

(56) References Cited

U.S. PATENT DOCUMENTS 6,427,446 B1 * 8/2002 Kraft ..... F23R 3/06 60/737
6,951,108 B2 * 10/2005 Burrus ..... F23R 3/283 60/746
(Continued)

FOREIGN PATENT DOCUMENTS

EP 2306091 A2 * 4/2011 ..... F23R 3/14
EP 2 551 596 A2 1/2013
(Continued)

OTHER PUBLICATIONS

Extended European Search Report issued in counterpart European Application No. 15179794.1 dated Dec. 4, 2015 (Six (6) pages).
(Continued)

*Primary Examiner* — Craig Kim
(74) *Attorney, Agent, or Firm* — Crowell & Moring LLP

(57) ABSTRACT

A gas turbine combustor of the present invention includes a cylindrical combustor liner, a cylindrical combustion chamber inside the combustor liner, and a burner that includes a plurality of fuel nozzles for injecting the gas fuel into the combustion chamber and an air hole plate with a plurality of air holes for guiding the compressed air into the combustion chamber. The air hole plate joins the combustor liner and is disposed between the fuel nozzles and the combustion chamber. The junction between the air hole plate and the combustor liner is provided with an inclined component which covers the junction and has a connecting surface connecting the air hole plate and the combustor liner.

3 Claims, 6 Drawing Sheets

(51) Int. Cl.
*F23R 3/10* (2006.01)
*F23R 3/34* (2006.01)
*F23R 3/60* (2006.01)

(52) U.S. Cl.
CPC ..... *F23R 3/60* (2013.01); *F23R 2900/00002* (2013.01); *F23R 2900/00014* (2013.01)

(58) Field of Classification Search
CPC .. F23R 3/283; F23R 3/60; F23R 2900/00014; F05D 2260/96; F05D 2260/9647; F05D 2270/14
See application file for complete search history.

(56) References Cited

U.S. PATENT DOCUMENTS

| | | | | |
|---|---|---|---|---|
| 9,121,611 | B2 * | 9/2015 | Koizumi | F23R 3/10 |
| 2001/0022088 | A1 | 9/2001 | Mandai et al. | |
| 2004/0011054 | A1 | 1/2004 | Inoue et al. | |
| 2011/0076628 | A1 * | 3/2011 | Miura | F23R 3/10 431/12 |
| 2011/0185703 | A1 | 8/2011 | Dodo et al. | |
| 2012/0305673 | A1 | 12/2012 | Matsuyama et al. | |
| 2013/0219903 | A1 | 8/2013 | Koizumi et al. | |
| 2013/0255261 | A1 * | 10/2013 | Abdelnabi | F23R 3/14 60/734 |
| 2013/0283802 | A1 * | 10/2013 | Kim | F23R 3/286 60/737 |

FOREIGN PATENT DOCUMENTS

| | | | |
|---|---|---|---|
| EP | 2 634 486 | A1 | 9/2013 |
| EP | 2 711 628 | A1 | 3/2014 |
| JP | 2000-130757 | A | 5/2000 |
| JP | 2001-254946 | A | 9/2001 |
| JP | 2003-148734 | A | 5/2003 |
| JP | 2008-96066 | A | 4/2008 |
| JP | 2011-144972 | A | 7/2011 |
| JP | 2012-31730 | A | 2/2012 |
| JP | 2012-37104 | A | 2/2012 |
| JP | 2012-251742 | A | 12/2012 |
| JP | 2013-24507 | A | 2/2013 |
| JP | 2013-29231 | A | 2/2013 |
| JP | 2013-108667 | A | 6/2013 |
| JP | 2013-177989 | A | 9/2013 |
| JP | 2013-190196 | A | 9/2013 |
| JP | 2014-62702 | A | 4/2014 |

OTHER PUBLICATIONS

Japanese-language Office Action issued in counterpart Japanese Application No. 2014-159330 dated Sep. 26, 2017 with English translation (Eight (8) pages).

* cited by examiner

GAS TURBINE COMBUSTOR

CLAIM OF PRIORITY

The present application claims priority from Japanese Patent Application JP 2014-159330 filed on Aug. 5, 2014, the content of which is hereby incorporated by reference into this application.

FIELD OF THE INVENTION

The present invention relates to a gas turbine combustor.

BACKGROUND OF THE INVENTION

In view of the recent trend of power cost reduction, effective utilization of natural resources, and global warming prevention, the consideration has been made with respect to effective utilization of the byproduct gas as the fuel, for example, the coke oven gas discharged from iron works and the off-gas discharged from oil refinery. In the integrated coal gasification combined cycle power generation plant (IGCC) which generates electricity by gasifying coal of rich resources, consideration has been made for means for reducing $CO_2$ emissions by the use of the system for capturing and storing carbon in the gas fuel (Carbon Capture and Storage or CCS).

The gas fuel including the aforementioned byproduct gas and coal-derived syngas from IGCC contains hydrogen ($H_2$) and carbon monoxide (CO) as the main component, the flame speed of which is higher than that of the natural gas (containing methane as the main component) generally used for the gas turbine. As a result, the high temperature flame is generated around the wall surface inside the combustion chamber, causing the risk of deteriorating reliability of the combustor. As an effective method for preventing local generation of the high temperature flame, the fuel is dispersed to ensure homogeneous combustion in the combustion chamber.

JP 2003-148734 discloses an exemplary gas turbine combustor configured to prevent generation of the high temperature flame by enhancing the fuel dispersibility to reduce emissions of NOx. The gas turbine combustor includes a plurality of fuel nozzles and air holes and a plurality of burners for injecting the fuel jet and the air jet generated around the fuel jet into the combustion chamber.

In the case of using the aforementioned byproduct gas and the coal-derived syngas from IGCC as the fuel in the gas turbine combustor, the method of operating gas turbine to be described below will be employed for safety purposes upon ignition. Firstly, the startup fuel which contains no hydrogen (for example, oil fuel) is used for ignition. In the operation under the part-load condition, the fuel is switched from the startup fuel to the gas fuel. Then, operation is further continued to reach the base load while controlling the number of burners for combusting the gas fuel. Once the base load is reached, the gas turbine is operated under the base-load condition. As the gasifier in the IGCC plant generates the coal-derived syngas using steam generated by waste heat from the gas turbine, the gas turbine has to be started up with the startup fuel other than the coal-derived syngas through the aforementioned operating method.

It is apprehended that pressure fluctuation occurs inside the combustor of the gas turbine to be operated through the aforementioned operating method in the process of increasing the load from the operation under the part-load condition to the operation under the base-load condition after switching the fuel from the startup fuel to the gas fuel. The pressure fluctuation may cause the risk of deteriorating structure reliability of the gas turbine combustor and limiting the load range that allows operation of the gas turbine under the load that cannot be increased to reach the base-load condition.

An object of the present invention is to provide a gas turbine combustor configured to prevent the pressure fluctuation in the process of increasing the load from the operation under the part-load condition to the operation under the base-load condition with respect to the gas fuel that contains hydrogen and carbon monoxide so as to sufficiently ensure the structure reliability and the load range that allows operation of the gas turbine.

SUMMARY OF THE INVENTION

A gas turbine combustor according to the present invention includes a cylindrical combustor liner, a cylindrical combustion chamber inside the combustor liner, and a burner including a plurality of fuel nozzles for injecting gas fuel into the combustion chamber and an air hole plate with a plurality of air holes for guiding compressed air into the combustion chamber. The air hole plate joins the combustor liner and is disposed between the fuel nozzles and the combustion chamber. A junction between the air hole plate and the combustor liner is provided with an inclined component which covers the junction and has a connecting surface connecting the air hole plate and the combustor liner.

A gas turbine combustor according to the present invention is able to prevent the pressure fluctuation in the process of increasing the load from the operation under the part-load condition to the operation under the base-load condition with respect to the gas fuel that contains hydrogen and carbon monoxide. This makes it possible to sufficiently ensure the structure reliability and the load range that allows operation of the gas turbine.

BRIEF DESCRIPTION CE THE DRAWINGS

FIG. 1 schematically shows structure of a gas turbine plant including a gas turbine combustor according to a first embodiment;

DETAILED DESCRIPTION OF THE PREFERRED EMBODIMENTS

First Embodiment

Figure 1:
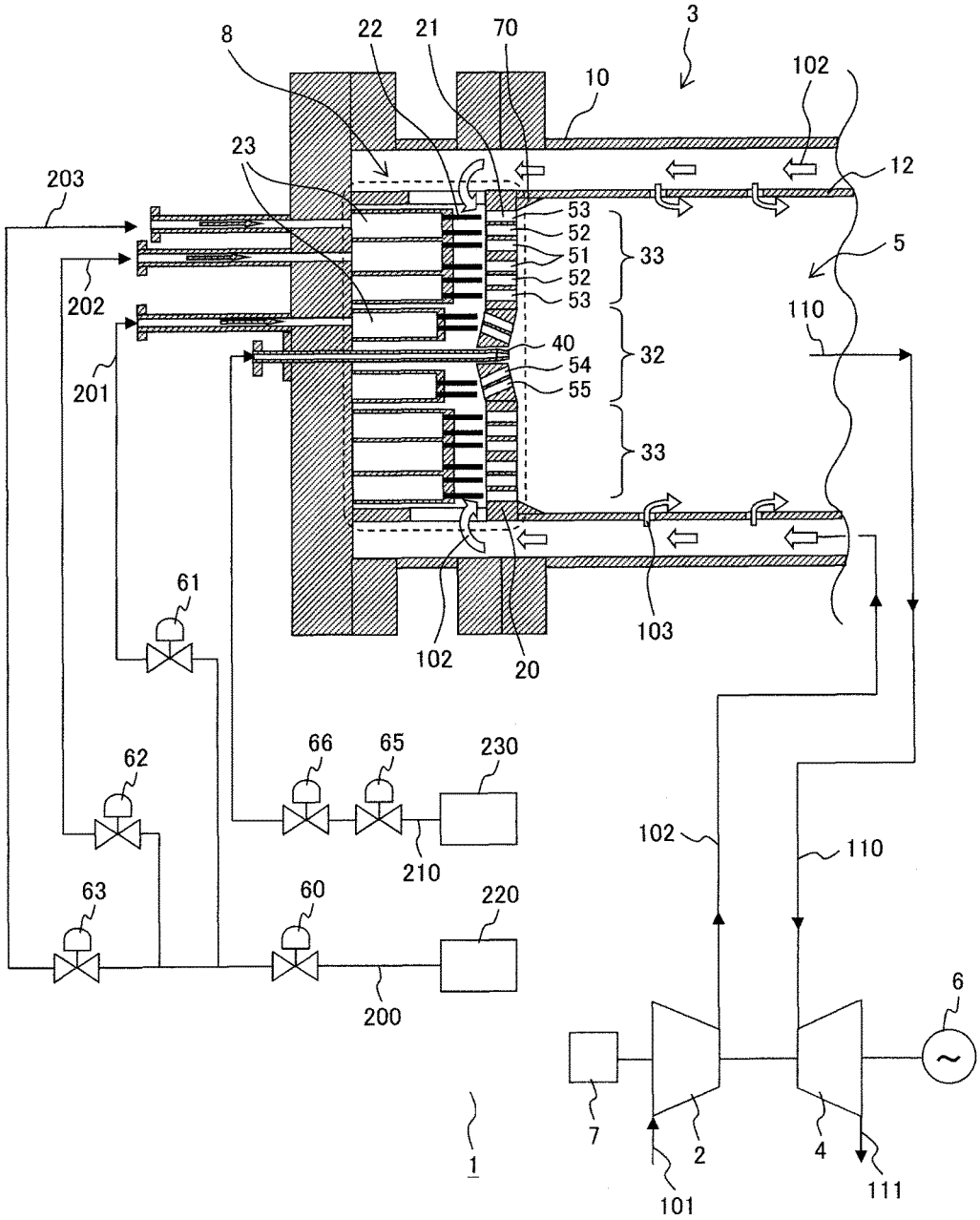

Referring to FIG. 1, a structure of the gas turbine plant will be described. FIG. 1 schematically shows the structure of the gas turbine plant which includes the gas turbine combustor (hereinafter simply referred to as "combustor") according to the first embodiment of the present invention. The gas turbine plant 1 mainly includes an air compressor 2, a combustor 3, a gas turbine 4, and a generator 6. FIG. 1 shows part of the combustor 3 as a cross-section on a plane including the central axis of the combustor 3.

The gas turbine plant 1 is configured to generate power as below. The air compressor 2 compresses air 101 sucked from ambient air to generate compressed air 102 which is supplied to the combustor 3. The combustor 3 combusts the compressed air 102 and gas fuel 200 (201, 202, 203) to generate combustion gas 110. The gas turbine 4 is driven by the combustion gas 110 generated by the combustor 3, and discharges exhaust gas 111. The generator 6 generates power by rotation power of the gas turbine 4. A gas turbine startup motor 7 is connected to the gas turbine 4 and the air compressor 2.

The combustor 3 includes an outer casing 10, a combustor liner 12 (combustion chamber liner 12), a combustion chamber 5, and a burner 8. The outer casing 10 has a cylindrical shape and is provided with the cylindrical combustion chamber liner 12 therein. The compressed air 102 flows through a flow passage formed between the outer casing 10 and the combustion chamber liner 12. The combustion chamber 5 has a cylindrical shape and is formed inside the combustion chamber liner 12. The compressed air 102 partially flows into the combustion chamber 5 as cooling air 103. The burner 8 includes an air hole plate 20 and a plurality of fuel nozzles 22. The air hole plate 20 is joined with the main chamber liner 12 and is disposed between the fuel nozzles 22 and the combustion chamber 5, and has a plurality of air holes 21 for guiding the compressed air 102 into the combustion chamber 5. The plurality of the fuel nozzles 22 inject the gas fuel 200 (201, 202, 203) toward the air holes 21 into the combustion chamber 5. The air holes 21 and the fuel nozzles 22 are arranged so that each one of the air hole 21 corresponds to each one of the fuel nozzles 22.

A junction between the air hole plate 20 and the combustion chamber liner 12 inside the combustion chamber 5 is provided with an inclined component 70 over an entire circumference of the combustion chamber 5. The inclined component 70 will be described later.

Figure 2:
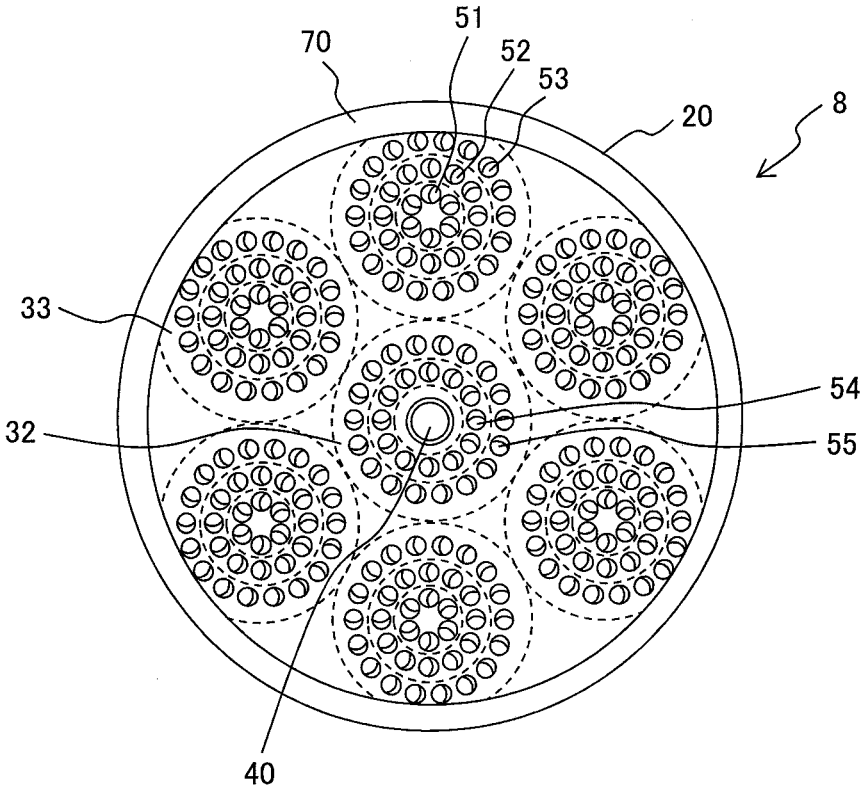
FIG. 2 is a front view of a burner of the gas turbine combustor according to the first embodiment when seen from the combustion chamber.

FIG. 2 is a front view of the burner 8 seen from the combustion chamber 5. The burner 8 includes a plurality of element burners. Specifically, the burner 8 includes one pilot burner 32 at the central axis of the combustion chamber 5, and a plurality of main burners 33 (FIG. 2 shows six main burners 33) around the pilot burner 32.

The pilot burner 32 has a burner axis at its center (central axis position of the combustion chamber 5), air hole groups 54, 55 forming two concentric circles around the burner axis as the center, and an oil spray nozzle 40 at the burner axis position. In other words, the pilot burner 32 includes the air hole groups 54, 55 in two rows which are concentrically positioned with respect to the oil spray nozzle 40 as the center. The oil spray nozzle 40 injects the oil fuel as the startup fuel into the combustion chamber 5.

Each of the main burners 33 has the burner axis at its center, and three air hole groups 51, 52, and 53 concentrically positioned around the burner axis. In other words, each of the main burners 33 includes the air hole groups 51, 52, and 53 in three rows which are concentrically positioned with respect to its burner axis as the center. Among the air hole groups 51, 52, and 53 in the main burners 33, the group that is closest to the burner axis will be referred to as the irst-row air hole group 51, the group that is second-closest to the burner axis will be referred to as the second-row air hole group 52, and the group that is farthest from the burner axis will be referred to as the third-row air hole group 53.

The area of the main burner 33 where the first-row air hole group 51 is located will be referred to as an "inner region of the main burner." The area of the main burner 33 where the second-row air hole group 52 and the third-row air hole group 53 are located will be referred to as an "outer region of the main burner." Alternatively, the fuel nozzles 22 corresponding to the first-row air hole group 51 may be referred to as the "inner region of the main burner," and the fuel nozzles 22 corresponding to the second-row air hole group 52 and the third-row air hole group 53 may be referred to as the "outer region of the main burner."

Referring back to FIG. 1, the description of the structure of the gas turbine plant 1 will be continued.

The plurality of the fuel nozzles 22 are connected to fuel dividers 23. The fuel dividers 23 distribute the gas fuel 200 to be supplied to the fuel nozzles 22. The gas fuel 200 is stored in a gas fuel tank 220 and is supplied to the fuel dividers 23 with a gas fuel supply system. The gas fuel supply system is provided with a fuel shut valve 60 and fuel control valves 61, 62, 63. The gas fuel 200 flows out from the gas fuel tank 220 is branched into three streams at the downstream of the fuel shut valve 60. The respective streams pass through the fuel control valves 61, 62, 63 and are supplied as the gas fuel 201, 202, 203 to the fuel nozzles 22 through the fuel dividers 23. The gas fuel 201 is supplied to the fuel, nozzles 22 for the pilot burner 32. The gas fuel 202 is supplied to the fuel nozzles 22 for the first-row air hole group 51 of the main burner 33. The gas fuel 203 is supplied to the fuel nozzles 22 for the second-row air hole group 52 and the third-row air hole group 53.

The startup oil fuel 210 is stored in an oil fuel tank 230 and supplied to the oil spray nozzle 40 with a startup oil fuel supply system. The startup oil fuel supply system is provided with a fuel shut valve 65 and a fuel control valve 66. The startup oil fuel 210 flows out from the oil fuel tank 230, passes through the fuel shut valve 65 and the fuel control valve 66, and is supplied to the oil spray nozzle 40.

The gas turbine combustor of this embodiment employs the fuel containing hydrogen and carbon monoxide as the gas fuel 200, for example, coke oven gas, refinery off-gas, and coal-derived syngas. Alternatively, it is possible to employ other gas fuel such as natural gas. The gas turbine combustor of this embodiment employs the oil fuel for the startup oil fuel 210, for example, gas oil, distillate oil and heavy oil A. In place of the oil fuel, it is also possible to employ the gas fuel such as natural gas and propane gas as the startup fuel for the gas turbine 4.

Figure 3:
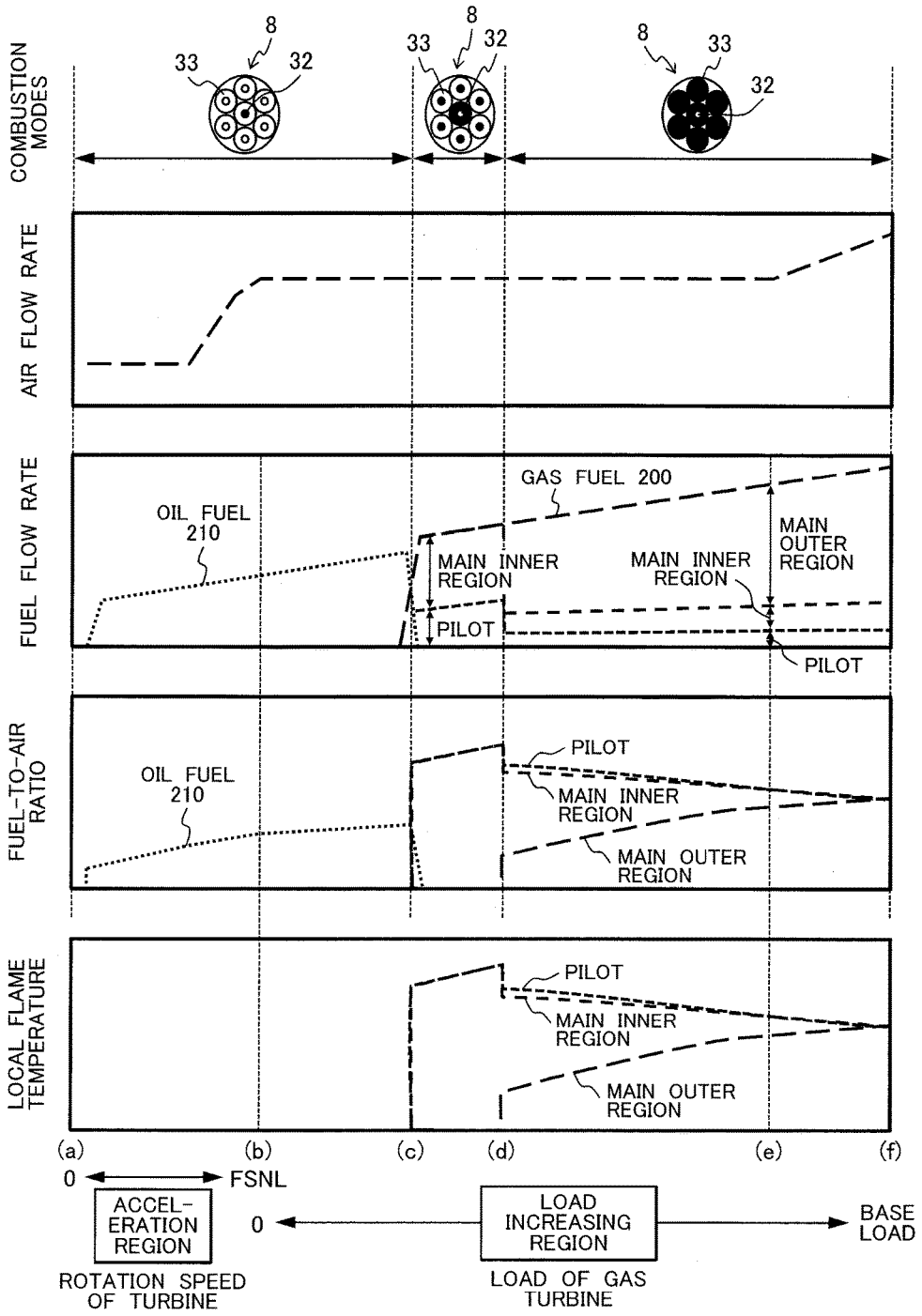
FIG. 3 is an explanatory view of the operating method of the gas turbine combustor according to the first embodiment.

FIG. 3 is an explanatory view of the operating method of the gas turbine combustor according to this embodiment. FIG. 3 represents each change in the air flow rate, fuel flow rate, fuel-to-air ratio, and local flame temperature from startup of the gas turbine 4 to attainment of the base load. The combustor 3 is operated so that these quantities will change as shown in FIG. 3. The air flow rate is defined as a flow rate of air supplied to the combustor 3. The fuel flow rate is defined as a flow rate of the fuel (startup oil fuel 210 and gas fuel 200) supplied to the combustor 3. The fuel-to-air ratio is defined as a ratio of mass flow rate of the fuel to air. The local flame temperature is defined as a temperature of the flame generated from the burner 8 (specifically, air hole groups 51 to 55 in the pilot burner 32 and the main burners 33) during combustion of the gas fuel 200.

The uppermost section of FIG. 3 shows the burners 8 as combustion modes, each having the combustion region during operation of the combustor 3 (region corresponding to locations of the oil spray nozzle 40 and the air hole groups 51 to 55) colored in black. Each view of the burners 8 in the uppermost section of FIG. 3 corresponds to the front view (FIG. 2) of the burner 8 seen from the combustion chamber 5.

The combustor 3 is basically operated through the following six steps from (a) to (f) to allow the gas turbine 4 to be operated under the base-load condition from the startup:

(a) startup of the gas turbine, (b) operation at the full rotation speed under no load (Full Speed No Load or FSNL), (c) switching of the fuels, (d) switching of the combustion modes, (e) increase in the air flow rate at the inlet of the combustor, and (f) operation under the base-load condition.

Hereinafter, the operating method of the combustor 3 will be described. In FIG. 3, the pilot burner 32, the inner region of the main burner, and the outer region of the main burner are simply referred to as "pilot," "main inner region," and "main outer region," respectively. In a graph indicating the fuel flow rate in FIG. 3, the proportions of the fuel supplied to the pilot burner 32, the inner region of the main burner, and the outer region of the main burner are indicated by arrows.

[Step (a) to (b), From Startup of the Gas Turbine to Operation at FSNL]

In step (a), the gas turbine startup motor 7 activates the gas turbine 4. When the rotation speed of the gas turbine 4 satisfies the ignition condition, the startup oil fuel 210 is supplied to the oil spray nozzle 40 of the pilot burner 32 for combustion of the startup oil fuel 210 with the oil spray nozzle 40 to allow ignition in the combustor 3. The uppermost section of FIG. 3 shows a burner 8 having a region colored in black, corresponding to the oil spray nozzle 40 at the center of the pilot burner 32. After ignition, as the flow rate of the startup fuel 210 (fuel flow rate) is increased, the rotation speed of the gas turbine 4 reaches the full rotation speed under no load (FSNL). The region from the startup of the gas turbine 4 to the generation of the load is referred to as an acceleration region. The air flow rate in the acceleration region is kept constant for a while after the startup and then increased.

[Step (b) to (c), From Operation in FSNL to Switching of the Fuels]

In step (b), after the rotation speed of the gas turbine 4 has reached the full rotation speed under no load (FSNL), the generator 6 starts generating the load. In this step, the air flow rate is constant, and the fuel flow rate is increased along with the load, thus increasing the fuel-to-air ratio. As the load is continuously increased, the load reaches a specified part-load condition for switching the fuels from the startup oil fuel 210 to the gas fuel 200 (see (c) in FIG. 3). The value of the part load may be preliminarily determined as the specified part-load condition in accordance with the gas turbine 4. The region where the load is increased from generation of the load by the generator 6 to the rated value will be referred to as the load increasing region.

[Step (c) to (d), From Switching of the Fuels to Switching of the Combustion Modes]

In step (c), the fuel is switched from the startup oil fuel 210 to the gas fuel 200 for operation. When the load reaches the specified part-load condition for switching the fuels, the flow rate of the startup oil fuel 210 is decreased while the flow rate of the gas fuel 200 is increased for switching the fuels. The gas fuel 200 is divided into the gas fuels 201, 202.

The gas fuel 201 is supplied to the pilot burner 32, and the gas fuel 202 is supplied to the fuel nozzles 22 for the first-row air hole group 51 in the main burners 33. Accordingly, the burner 8 is operated for combustion in the region where the air hole groups 54, 55 of the pilot burner 32 exist and in the inner region of the main burner. The uppermost section of FIG. 3 shows a burner 8 having regions colored in black which are the region were the air hole groups 54, 55 of the pilot burner 32 exist and the inner region of the main burner. The combustion mode of the burner 8 will be referred to as the "partial combustion mode" in which the burner 8 is operated for combustion in the region where the air hole groups 54, 55 of the pilot burner 32 exist and in the inner region of the main burner.

After switching the fuels, the flow rate of the gas fuel 200 is increased along with the load, increasing the fuel-to-air ratio. Each of the local flame temperatures at the pilot burner 32 and the inner region of the main burner is increased.

[Step (d) to (e), From Switching of the Combustion Modes to Increase in the Air Flow Rate at the Inlet of the Combustor]

In step (d), the combustion mode of the gas fuel 200 is switched from the partial combustion mode to the full combustion mode for operation. When the load reaches a specified part-load condition for switching the combustion modes, the gas fuel 200 is divided into the gas fuels 201, 202 and 203.

The gas fuel 201 is supplied to the pilot burner 32, the gas fuel 202 is supplied to the fuel nozzles 22 for the first-row air hole group 51 of the main burner 33, and the gas fuel 203 is supplied to the fuel nozzles 22 for the second-row air hole group 52 and the third-row air hole group 53. Accordingly, the burner 8 is operated for combustion in the region where the air hole groups 54, 55 of the pilot burner 32 exist and in the inner region of the main burner and the outer region of the main burner. The uppermost section of FIG. 3 shows a burner 8 having regions colored in black which are the region where the air hole groups 54, 55 of the pilot burner 32 exist, the inner region of the main burner, and the outer region of the main burner. The combustion mode of the burner 8 will be referred to as the "full combustion mode" in which the burner 8 is operated for combustion in the region where the air hole groups 54, 55 of the pilot burner 32 exist and in the inner region of the main burner and the outer region of the main burner.

After switching the combustion modes, the fuel is dispersed to the outer region of the main burner to establish the lean combustion state, resulting in increased fuel flow rate in the outer region of the main burner. As a result, the local flame temperature at the pilot burner 32 and in the inner region of the main burner is decreased, and the local flame temperature in the outer region of the main burner is increased. After switching the combustion modes, the load is further increased to reach a condition for increasing the air flow rate under control to set the exhaust gas temperature.

[Step (e) to (f), From Increase in the Air Flow Rate at the Inlet of the Combustor to Operation Under the Base-Load Condition]

In step (e), the air flow rate at the inlet of the combustor 3 is increased. When the load is increased and the temperature of the combustion gas 110 is raised at the outlet of the combustor 3, the temperature of the exhaust gas 111 discharged from the gas turbine 4 exceeds a predetermined limit value. Therefore, when the load reaches a condition that causes the temperature of the exhaust gas 111 to exceed the limit value, the air flow rate is increased at the inlet of the combustor 3 to control the temperature of the exhaust gas 111 (exhaust temperature) to be equal to or lower than the limit value.

Thereafter, when the load is further increased to reach the base load, the gas turbine 4 is operated under the base-load condition. In the operation under the base-load condition, local flame temperatures at the pilot burner 32, in the inner region of the main burner, and the outer region of the main burner is equal to each other. Then the fuel flow rate is changed to attain the homogeneous lean combustion over the entire region of the burner 8. For example, the fuel flow rate to the outer region of the main burner is increased and the fuel flow rate to the pilot burner 32 and the inner region of the main burner is reduced.

The part of the load increasing region except the part under the base-load condition (100% load) will be referred to as the part-load region.

Upon operating the combustor 3 in accordance with the above method, there is concern over occurrence of pressure fluctuation inside the combustor 3 in the process of increasing the load from the part-load condition to the base-load condition. Occurrence of the pressure fluctuation may deteriorate the structure reliability of the combustor 3 and limit the load range that allows operation of the gas turbine 4. It is therefore necessary to prevent the pressure fluctuation inside the combustor 3.

Figure 4A:
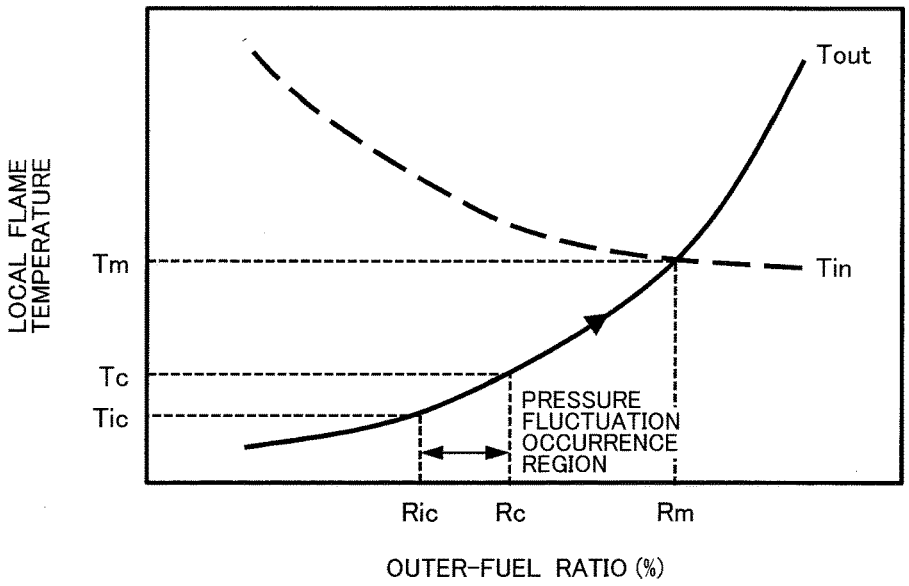
FIG. 4A is a graph representing each change in the local flame temperature Tin in the inner region of the main burner and the local flame temperature Tout in the outer region of the main burner with respect to the ratio R of the fuel in the outer region of the main burner.
Figure 4B:
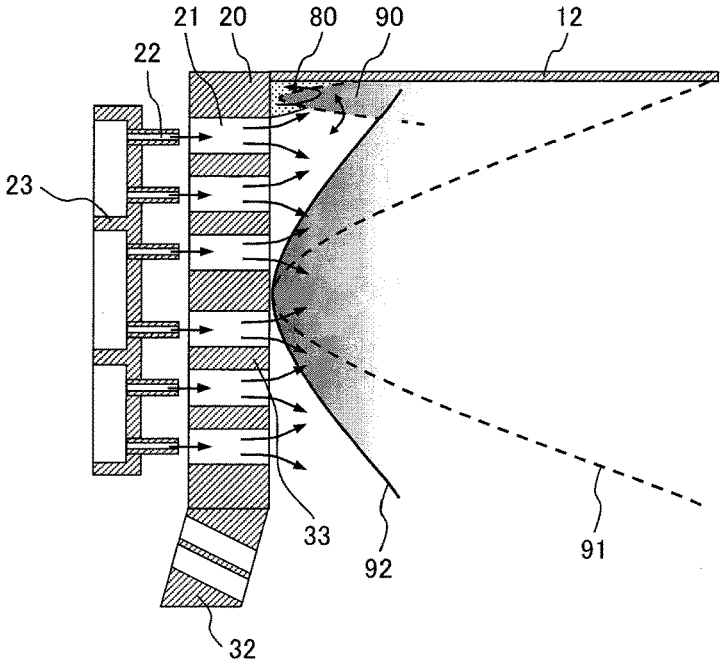
FIG. 4B is an enlarged view of the main burner.

With reference to FIGS. 4A and 4B, the mechanism how the pressure fluctuation occurs will be described. FIG. 4A is a graph representing each change in the local flame temperature Tin in the inner region of the main burner and the local flame temperature Tout in the outer region of the main burner with respect to the ratio R of the fuel supplied to the outer region of the main burner. FIG. 4B is an enlarged sectional view of one of the main burners 33 on the plane including the central axis of the combustion chamber 5. The ratio R of the fuel supplied to the cuter region of the main burner will be referred to as the "outer-fuel ratio R," the local flame temperature Tin in the inner region of the main burner will be referred to as the "inner local-flame temperature Tin," and the local flame temperature Tout in the outer region of the main burner will be referred to as the "outer local-flame temperature Tout."

The outer-fuel ratio R(%) is expressed by the following equation (1) using the flow rate of the fuel supplied to the outer region of the main burner (fuel flow rate in the outer region of the main burner) and the flow rate of the fuel supplied to the inner region of the main burner (fuel flow rate in the inner region of the main burner):

$$\text{Outer-fuel ratio } R(\%) = (\text{the fuel flow rate in the outer region of the main burner})/(\text{the fuel flow rate in the inner region of the main burner} + \text{the fuel flow rate in the outer region of the main burner}). \quad (1)$$

As described above, in the process of increasing the load from the part-load condition to the base-load condition (step (c) to (f)), the fuel flow rate to the outer region of the main burner is increased to raise the outer-fuel ratio R. Accordingly, as FIG. 4A shows, the outer local-flame temperature Tout is increased and the inner local-flame temperature Tin is decreased along with increase in the ratio R.

As FIG. 4A shows, it is assumed that the homogeneous lean combustion is attained under the base-load condition when the outer-fuel ratio R is Rm, that is, Tout=Tin (=Tm). It is also assumed that, when the outer-fuel ratio R is increased, the outer local-flame temperature Tout is Tic at which the pressure fluctuation starts to occur inside the combustor 3 and the outer local-flame temperature Tout is Tc at which the pressure fluctuation stops. Furthermore, it is assumed that the outer-fuel ratio R is Ric at which the outer local-flame temperature Tout is Tic and the outer-fuel ratio R is Rc at which the outer local-flame temperature Tout is Tc. Therefore, the range of the outer-fuel ratio R between Ric and Rc corresponds to the range where the pressure fluctuation occurs (pressure fluctuation occurrence region).

The outer-fuel ratio R is increased to establish R=Rm, and the outer local-flame temperature Tout is increased. Then the incomplete combustion state (R≤Ric, Tout≤Tic) of the fuel at the main burner 33 is shifted to the complete combustion state (R≥Rc, Tout≥Tc).

FIG. 4B also illustrates the flames at the main burner 33 both in the incomplete combustion state and the complete combustion state, which are an unstable flame 91 and a stable flame 92, respectively. In the incomplete combustion state, because the flame generated by the fuel in the outer region of the main burner is small in quantity, has a lower temperature, and accordingly is unstable, the flame is swept by the compressed air 102 to form the unstable flame 91 having a long flame front extending to the downstream side. Meanwhile, in the complete combustion state, because the flame generated by the fuel in the outer region of the main burner is large in quantity, has a higher temperature, and accordingly is stable, the flame is not swept by the compressed air 102, spreading to the periphery to form the stable flame 92 having a flame front located at the upstream side.

As the outer-fuel ratio R is increased along with the increase in the load, the state of the flame at the main burner 33 transits from the unstable flame 91 to the stable flame 92. In the transition region (the region of Ric≤R≤Rc in FIG. 4A), two different states of the unstable flame 91 and the stable flame 92 are mixed, thus bringing the flame into the unstable state.

On the junction between the air hole plate 20 and the combustion chamber liner 12, a recirculation flow 80 is generated by the air flow (flow of the compressed air 102) jetted from the air holes 21. In the region where the recirculation flow 80 is generated, the air flow velocity is relatively low so that the propagation speed of the flame exceeds the air flow velocity. For this reason, the flame intrudes in the recirculation flow 80 to generate an attached flame 90.

The recirculation flow 80 pulsates because it is generated by the air flow in the turbulent state, and the attached flame 90 also pulsates because the recirculation flow 80, which pulsates, is the base point of the attached flame 90. As a result, when the outer-fuel ratio R is increased up to Rm, the pulsation of the attached flame 90 works together with the behavior of the flame at the main burner 33 in the aforementioned transition region, and then the pressure fluctuates inside the combustor 3. If the pressure fluctuation occurs in the process of increasing the outer-fuel ratio R up to Rm, the ratio R is no longer increased to be equal to or higher than the ratio R obtained when the pressure has fluctuated. It is therefore impossible to increase the load for operation under the base-load condition, thus limiting the load range that allows operation of the gas turbine 4.

As described above, the attached flame 90 generated by the recirculation flow 80 is one of the causes of the pressure fluctuation inside the combustor 3. Therefore, it is necessary to prevent generation of the recirculation flow 80 for suppressing the pressure fluctuation.

In the present embodiment, an inclined component 70 is provided on the junction between the air hole plate 20 and the combustion chamber liner 12 to prevent generation of the recirculation flow 80. The inclined component 70 is formed on the area of the entire circumference of the combustion chamber 5.

Figure 5:
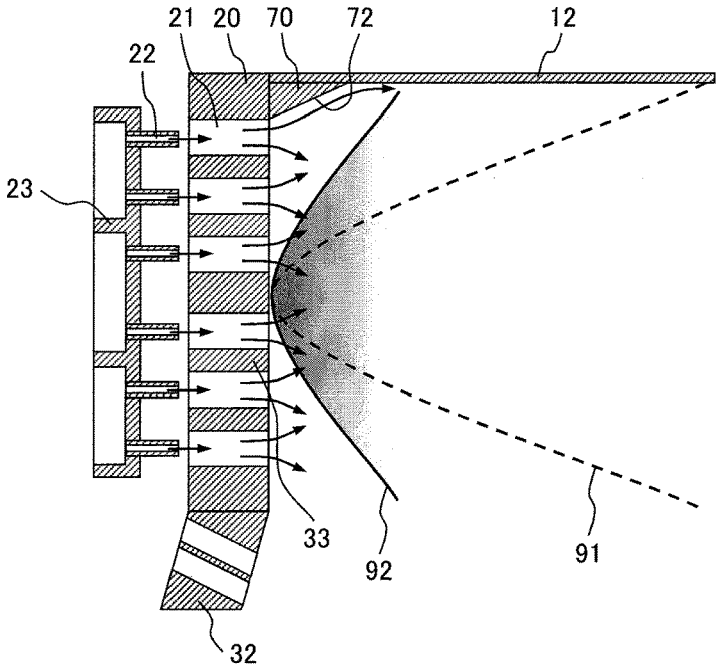
FIG. 5 is an enlarged view of the main burner configured to have an inclined component on a junction between an air hole plate and a combustion chamber liner.
Figure 7A:
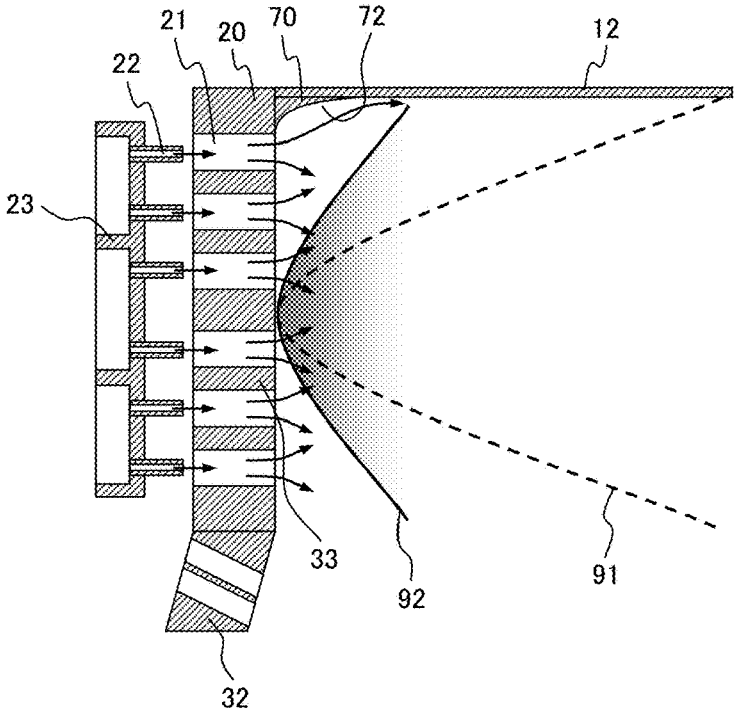
FIGS. 7A and 7B is an enlarged view of the main burner having connecting surfaces that connect an air hole plate and a combustion chamber liner.

FIG. 5 is an enlarged view of one of the main burners 33, having the inclined component 70 on the junction between the air hole plate 20 and the combustion chamber liner 12. Likewise FIG. 4B, FIG. 5 is a sectional view of the main burner 33 on the plane including the central axis of the combustion chamber 5. The inclined component 70 is a member which covers the junction between the air hole plate 20 and the combustion chamber liner 12, and has a connecting surface 72 for connecting the air hole plate 20 and the combustion chamber liner 12. The connecting surface 72 for connecting the air hole plate 20 and the combustion chamber liner 12 has a flat surface shape or a curved surface shape (linear or curved shape on the cross section including the central axis of the combustion chamber 5, a curved surface shape of the connecting surface 72 shown in FIG. 7A, for example, that smoothly connects the air hole plate 20 and the combustion chamber liner 12). In other words, the inclined component 70 connects the air hole plate 20 and the combustion chamber liner 12 in the linear or curved shape and covers the junction between the air hole plate 20 and the combustion chamber liner 12. FIG. 5 shows, as an example, the connecting surface 72 having a flat surface shape (linear shape on the cross section including the central axis of the combustion chamber 5).

Figure 7B:
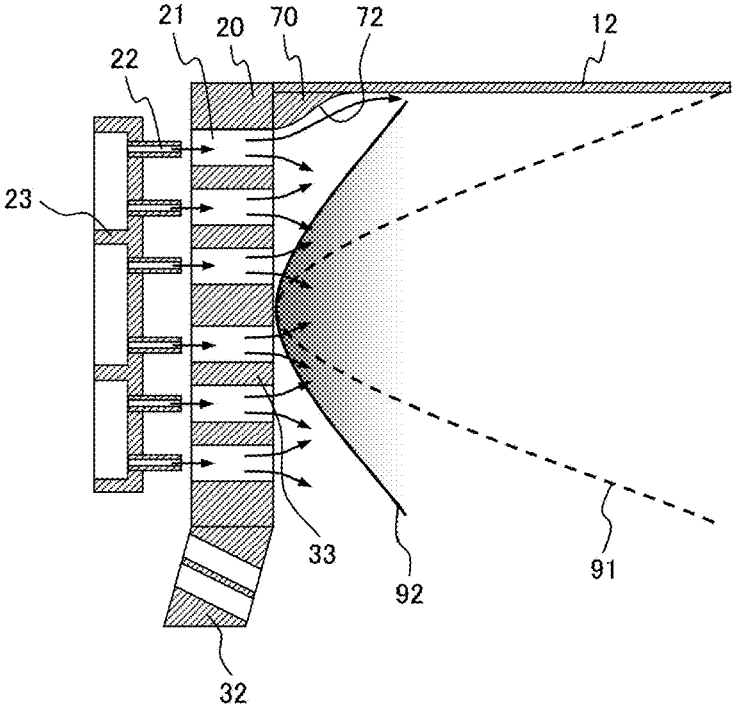

In the case where the inclined component 70 connects the air hole plate 20 and the combustion chamber liner 12 with a curved surface, the connecting surface 72 may be formed to have a curved surface smoothly connecting the air hole plate 20 and the combustion chamber liner 12. Alternatively, the connecting surface 72 may be formed to have a shape (for example, streamlined surface, shown in FIG. 7B) following the flow of air jetted from the air holes 21.

It is possible to appropriately determine, by preliminarily conducting simulations and/or tests, the angle of the connecting surface 72 to the air hole plate 20 in a configuration that the inclined component 70 connects the air hole plate 20 and the combustion chamber liner 12 with a flat surface or the shape of the connecting surface 72 in a configuration that the inclined component 70 connects the air hole plate 20 and the combustion chamber liner 12 with a curved surface.

With reference to FIG. 5, the advantageous effect of the inclined component 70 will be described. The inclined component 70 is disposed on the junction between the air hole plate 20 and the combustion chamber liner 12, that is, in the region where the recirculation flow 80 is generated as described referring to FIG. 4B. The air flow jetted from the air holes 21 flows along the connecting surface 72 of the inclined component 70. Therefore, the inclined component 70 serves to prevent generation of the recirculation flow 80 in the region where the recirculation flow 80 is generated without the inclined component 70 as in FIG. 4B. Since the air flows along the connecting surface 72 at sufficiently higher velocity, generation of the attached flame 90 is prevented, leading to suppression of the pressure fluctuation inside the combustor 3.

As described above, the gas turbine combustor of this embodiment prevents the occurrence of the pressure fluctuation in the process of increasing the load from the operation under the part-load condition to the operation under the base-load condition. This makes it possible to sufficiently enhance the structure reliability of the gas turbine combustor and ensure the load range that allows operation of the gas turbine.

Second Embodiment

A gas turbine combustor according to a second embodiment of the present invention will be described. In the first embodiment, the combustor 3 includes the inclined component 70 on the junction between the air hole plate 20 and the combustion chamber liner 12 over the entire circumference of the combustion chamber 5. In this embodiment, the combustor 3 includes an inclined component partially formed in the combustion chamber 5 in a circumferential direction on the junction between the air hole plate 20 and the combustion chamber liner 12. The combustor 3 of this embodiment is different from that of the first embodiment only in this feature. The following description will be made with respect to the different feature.

Figure 6:
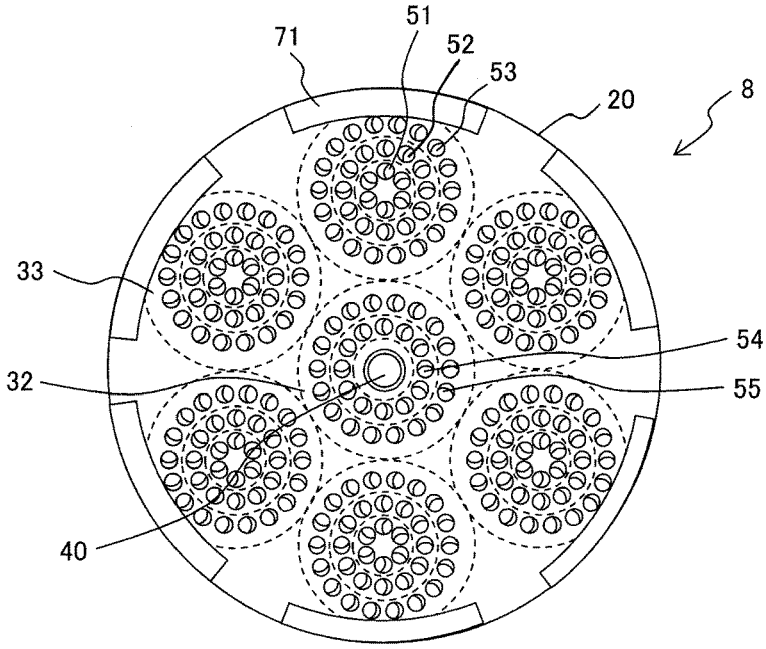
FIG. 6 is a front view of the burner of the gas turbine combustor according to a second embodiment when seen from the combustion chamber.

FIG. 6 is a front view of the burner 8 seen from the combustion chamber 5 likewise FIG. 2. The combustor 3 of this embodiment includes at least one inclined component 71 which is formed on at least one region of the junction between the air hole plate 20 and the combustion chamber liner 12, the region being a region where the air hole groups 51, 52, 53 of the main burners 33 are positioned when seen from the central axis (the position of the oil spray nozzle 40) of the combustion chamber 5 on the air hole plate 20. In FIG. 6, the burner 8 has six main burners 33, and accordingly, six inclined components 71 are disposed at six positions.

As described in the first embodiment, the pressure fluctuation occurs inside the combustor 3 owing to the coupling work of the attached flame 90 and the flame at the main burners 33. Therefore, when the inclined components 71 are provided only in regions of the junction between the air hole plate 20 and the combustion chamber liner 12, the regions being regions where flames at the main burners 33 exist, the occurrence of the pressure fluctuation inside the combustor 3 can be suppressed likewise in the first embodiment. Therefore, in this embodiment, the inclined components 71 are disposed only in the regions of the junction in which the air hole groups 51, 52, 53 of the main burners 33 are positioned (i.e. the regions of the junction in which flames of the main burners 33 exist) when seen from the central axis of the combustion chamber 5 on the air hole plate 20.

According to this embodiment limiting the location of the inclined component 71 in the junction, advantageous effects are obtained such as reduction in the material cost and in the structure weight.

EXPLANATION OF REFERENCE CHARACTERS

1: gas turbine plant, 2: air compressor, 3: combustor, 4: gas turbine, 5: combustion chamber, 6: generator, 7: gas turbine startup motor, 8: burner, 10: outer casing, 12: combustor liner (combustion chamber liner), 20: air hole plate, 21: air hole, 22: fuel nozzles, 23: fuel divider, 32: pilot burner, 33: main burner, 40: oil spray nozzle, 51: first-row air hole group, 52: second-row air hole group, 53: third-row air hole group, 54,55: air hole group, 60: fuel shut valve, 61,62,63: fuel control valve, 65: fuel shut valve, 66: fuel control valve, 70,71: inclined component, 72: connecting surface, 80: recirculation flow, 90: attached flame, 91: unstable flame, 92: stable flame, 101: air, 102: compressed air, 103: cooling air, 110: combustion gas, 111: exhaust gas, 200,201,202,203: gas fuel, 210: startup oil fuel, 220: gas fuel tank, 230: oil fuel tank.

What is claimed is:

1. A gas turbine combustor comprising:

a cylindrical combustor liner;

a cylindrical combustion chamber inside the combustor liner; and a burner including a plurality of fuel nozzles for injecting gas fuel into the combustion chamber, and an air hole plate with a plurality of air holes for guiding compressed air into the combustion chamber, wherein:

the air hole plate joins the combustor liner, and is disposed between the fuel nozzles and the combustion chamber;

the gas turbine combustor further comprises a plurality of inclined components, a first inclined component of the plurality of inclined components being on a junction between the air hole plate and the combustor liner, the first inclined component covering the junction and having a connecting surface that connects and is inclined with respect to the air hole plate and the combustor liner;

each of the inclined component of the plurality of inclined components is formed on a respective part of the combustion chamber in a circumferential direction;

the burner includes a pilot burner at a position of a central axis of the combustion chamber, and a plurality of main burners around the pilot burner;

each of the main burners includes the plurality of the air holes; and each of the inclined component is provided in a respective region of the junction, in which the air holes of the main burners are positioned when seen from the central axis of the combustion chamber on the air hole plate.

2. The gas turbine combustor according to claim 1, wherein the first inclined component has the connecting surface with a linear shape on a cross section including a central axis of the combustion chamber.

3. The gas turbine combustor according to claim 1, wherein the first inclined component has the connecting surface with a curved shape on a cross section including a central axis of the combustion chamber.

* * * * *